United States Patent [19]

Menchetti

[11] Patent Number: 4,936,067

[45] Date of Patent: Jun. 26, 1990

[54] STUD EXTENDER INTERLOCK AND METHOD OF ERECTION

[75] Inventor: Robert J. Menchetti, Buffalo, N.Y.

[73] Assignee: National Gypsum Company, Dallas, Tex.

[21] Appl. No.: 367,176

[22] Filed: Jun. 16, 1989

Related U.S. Application Data

[63] Continuation of Ser. No. 277,836, Nov. 30, 1988, abandoned, which is a continuation of Ser. No. 155,911, Feb. 16, 1988, abandoned.

[51] Int. Cl.[5] ..... E04B 2/78

[52] U.S. Cl. ..... 52/243; 52/632; 52/741; 52/241

[58] Field of Search ..... 52/241, 248, 290, 664, 52/348, 349, 350, 741, 745, 632, 126.1, 126.3, 243

[56] References Cited

U.S. PATENT DOCUMENTS

| | | | |
|---|---|---|---|
| 1,998,688 | 4/1935 | Robinson | 52/241 |
| 2,966,708 | 1/1961 | Freeman | 52/290 |
| 3,008,550 | 11/1961 | Miles | 52/290 |
| 3,125,193 | 3/1964 | Brown | 52/481 |
| 4,397,127 | 8/1983 | Mieyal | 52/241 |

FOREIGN PATENT DOCUMENTS

T480273 8/1973 Australia .

*Primary Examiner*—John E. Murtagh

*Attorney, Agent, or Firm*—Laird F. Miller; Robert F. Hause

[57] ABSTRACT

An extendable stud having a stud body and a stud extender telescopically engaged with the bottom of the stud body, in which the stud extender bottom end has an interlocking slot, engageable with an upwardly extending enlarged elongate head on a floor track, which becomes locked to the enlarged head by raising the stud from an angled engaging position to a vertical locked position, whereat the stud body can be easily moved upwardly, into a ceiling channel, forming an elongated stud.

9 Claims, 3 Drawing Sheets

STUD EXTENDER INTERLOCK AND METHOD OF ERECTION

This application is a continuation of copending application, Ser. No. 277,836, filed Nov. 30, 1988, now abandoned, which application was a continuation of application Ser. No. 155,911, filed Feb. 16, 1988, now abandoned.

BACKGROUND OF THE INVENTION

This invention relates to an extendable metal stud and more particularly to a structure including an extendable metal stud, a floor track for attachment to the bottom of the stud, a ceiling track for receiving the top of the stud and means for affixing the telescoping portions of the extendable stud in a fixed extended condition.

U.S. Pat. No. 3,492,766 discloses an extendable steel stud, to compensate for variations in height between the floor and the ceiling. The standard stud body is channel shaped and has a stud extender or adaptor which effectively makes the stud suitable for use throughout a range of varying heights. The stud extender is slidably disposed within the top portion of the channel shaped standard stud body. To use the stud extender, a person must reach up, high above the head, or climb a ladder, and manually grasp the stud extender, pull it up, while holding the stud body down with the other hand. The top of the stud extender is guided into a ceiling track, and means are then used to affix the stud body and stud extender in the relatively elongated relationship.

An extendable stud with means for extending it with greater ease and requiring less time would provide substantial cost savings in the erection of a building with a great number of partition walls.

SUMMARY OF THE INVENTION

The present invention includes a channel shaped standard stud body with a stud extender in the bottom end of the stud body. The stud extender has notched webs which are formed to easily engage a top flange on a floor track, whereby a person can affix the stud extender to the floor track while standing beside the floor track. The engagement of the stud extender with the floor track is such that when the stud body is moved, following engagement, to a vertical position, the stud body can be moved vertically upward into a downwardly opening ceiling track without disengaging the stud extender from the floor track. The stud extender thus slides partially out from the stud body as the stud body is moved vertically upwardly.

When the stud body has been moved vertically into the ceiling track, the stud body and the stud extender are mechanically affixed to prevent further relative movement, as by a self-tapping screw inserted into the two overlapping parts.

It is an object of the present invention to provide an improved extendable metal stud for use in hollow partitions.

It is a further object of the invention to provide an extendable metal stud having means for engaging a floor track, for easy adjustment of the length of the extendable stud, for use in constructing a first wall, and suitable for removing from such first wall for reuse in a second wall of somewhat different height.

It is a still further object to provide a floor track and vertical stud combination which provides improved access for utilities along the extent of the floor track and from there up into the hollow between the hollow wall opposed wallboards.

These and other objects and advantages of the invention will be more fully apparent when considered in relation to the preferred embodiments thereof as set forth in the specification and as shown in the drawings in which.

DESCRIPTION OF THE PREFERRED EMBODIMENTS

Figure 1:
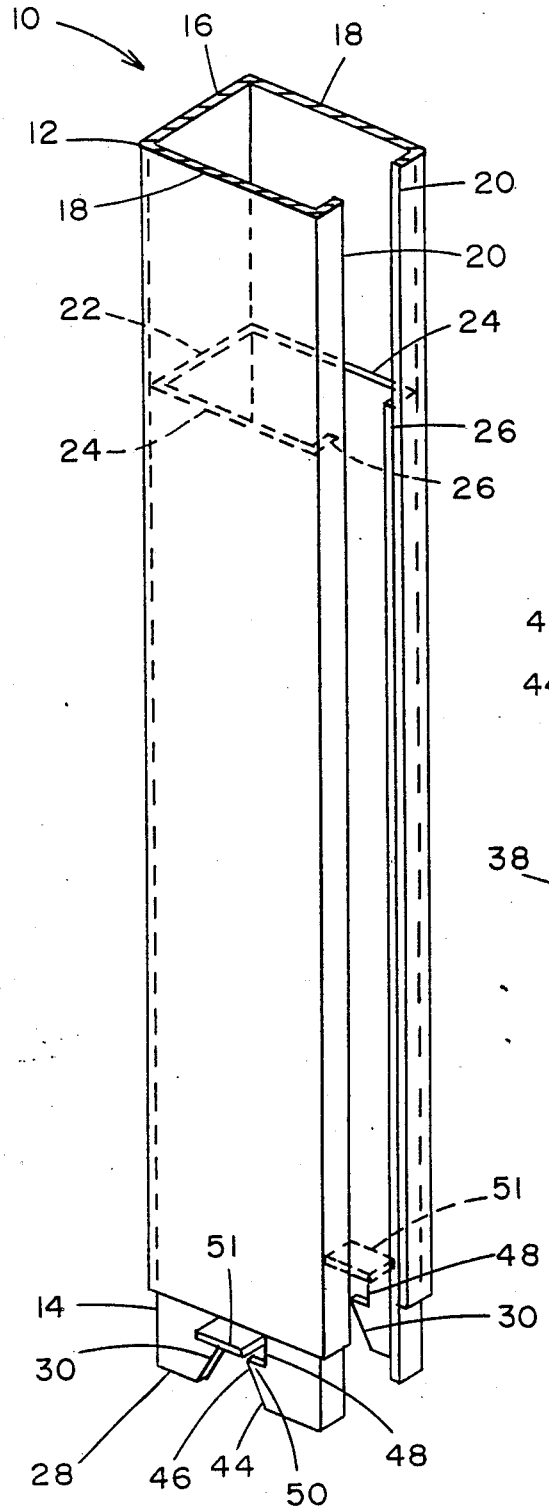
FIG. 1 is an isometric view of the bottom portion of an extendable stud in accordance with the present invention.

Referring to FIG. 1, there is shown the bottom portion of an extendable U-stud 10, which consists essentially of a channel shaped elongate formed sheet metal stud body 12 and a short, channel shaped formed sheet metal stud extender 14, telescopically disposed within the channel shaped stud body 12.

The stud body 12 includes a solid face 16, a pair of spaced parallel webs 18 extending perpendicularly from the solid face 16, and a pair of inwardly directed flanges 20 forming the face of the stud opposite to the solid face 16. The stud extender 14 includes a solid face 22, a pair of spaced parallel webs 24, and a pair of inwardly directed flanges 26, all sufficiently smaller than the corresponding parts of the stud body 12 such that the stud extender 14 fits somewhat tightly within the bottom end of the stud body 12.

Figure 2:
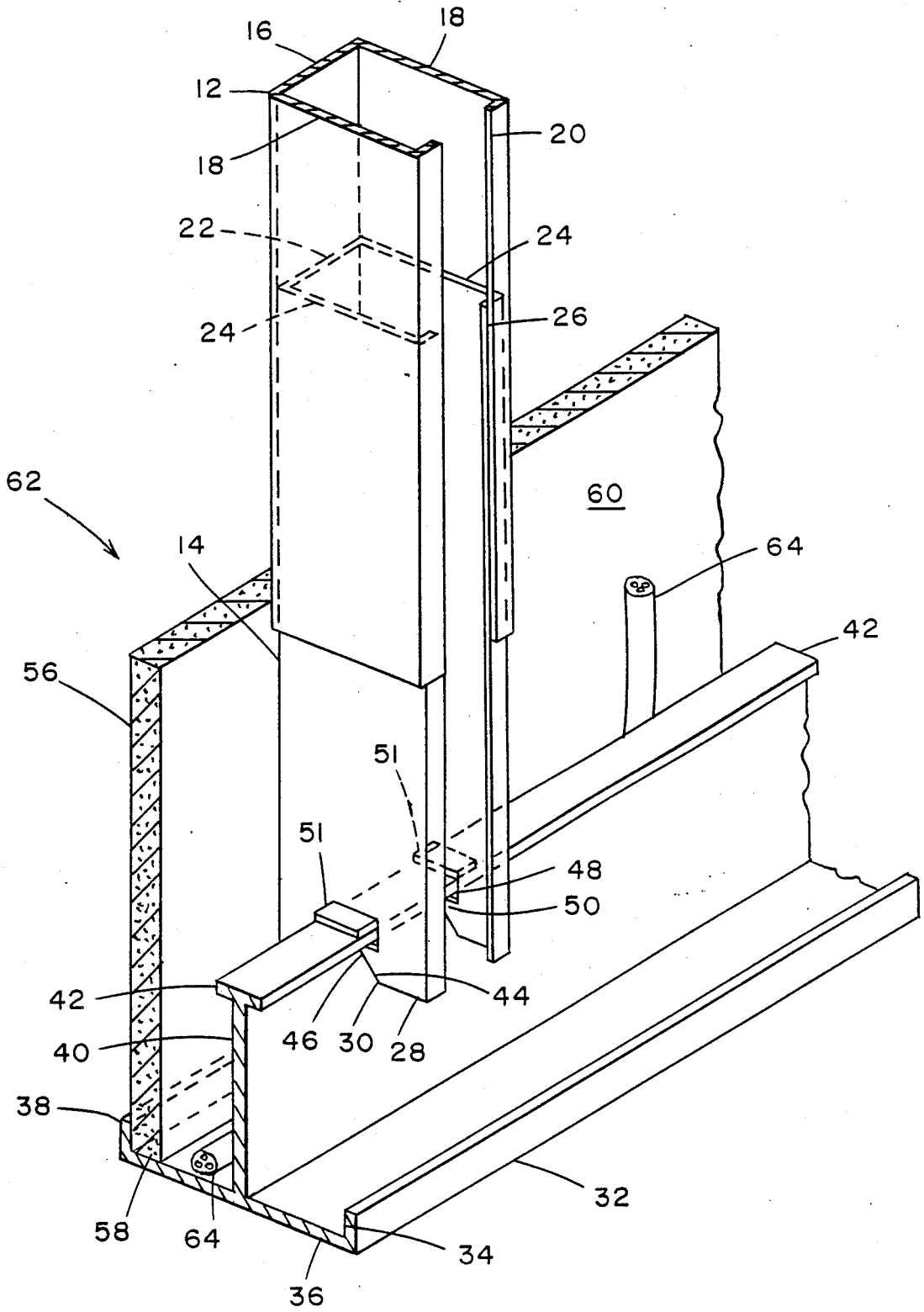
FIG. 2 is an isometric view of the bottom portion of the extendable stud of FIG. 1, with the stud extender engaged with a floor track, with the stud body moved upwardly relative to the stationary stud extender, and with wallboard disposed on the far side of the stud, in accordance with the invention.

The two webs 24 of the stud extender each have a bottom end 28 which is cut to form an interlocking slot 30 extending upwardly thereinto, formed to interlock with the floor track 32, as shown in FIG. 2.

Floor track 32 includes an upwardly opening channel 34 having a bottom wall 36 and two sidewalls 38. Extending upwardly from the center of the bottom wall 36 is a relatively strong, solid central vertical wall 40 with a relatively widened, elongate head 42 along the top of the central vertical wall 40. The widened head 42 is preferably a pair of opposed, elongate flanges 43, which permit engagement of an extendable stud 10 from either side of the floor track 32, as will be explained hereinafter.

Figure 3:
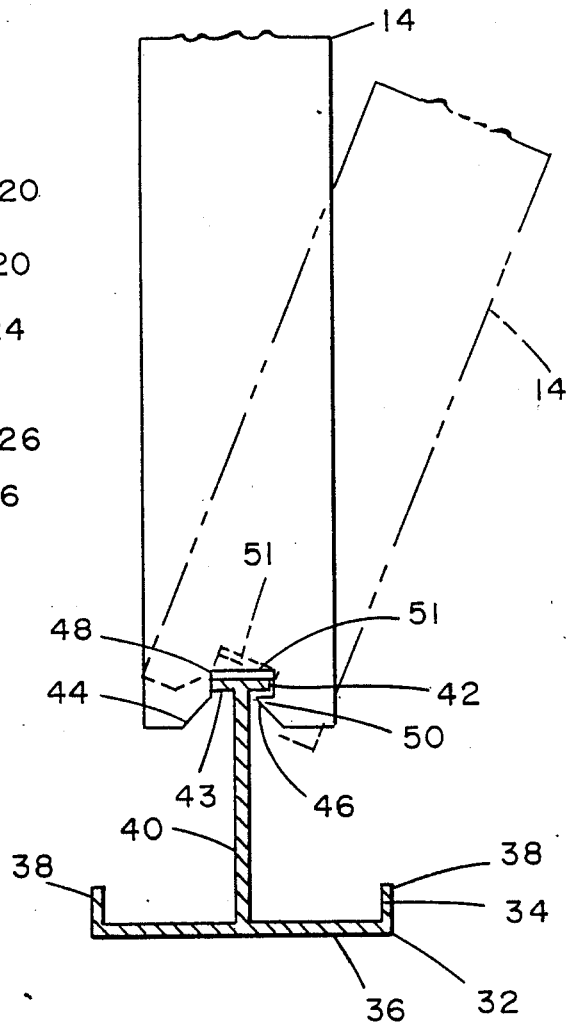
FIG. 3 is an end view of the bottom portion of the extendable stud engaged on the top flange of a floor track, with the bottom portion of the stud also shown in broken lines, depicting the initial engagement of the stud onto the floor track.

Interlocking slot 30 has a shape which includes a wide bottom opening 44 tapering down to a relatively narrow neck 46 and a wider head area 48, formed by a protruding tongue 50 on one side, which creates the narrow neck and the wider head. The wide bottom opening 44 permits the floor track head 42 to be placed above tongue 50, when the stud 10, and thus the slot 30, are at an angle, between about 20° and about 50° to the vertical, and relative to the floor track 32. If the floor track head 42 is above the tongue 50 as the stud is moved to a vertical position, the floor track head 42 becomes locked above the tongue 50, as shown in FIG. 3.

At the top of wider head area 48 of each slot 30 is a bent-out tab 51, formed from the sheet metal which is removed, by partial cutting and bending, to form the slot head area 48. Tabs 51 are disposed at a 90° angle to the plane of each web 24. Tabs 51 provide two functions. Tabs 51 limit the movement of stud extender 14 into stud body 12, such that the bottom end 28, with slot 30, is always protruding out of stud body 12 sufficient for initiating the interlocking engagement of floor track 32 with slot 30. Tabs 51 also provide a greater area of engagement of the stud extender 14 with the floor track head 42, for improved support of the extendable stud 10.

Figure 4:
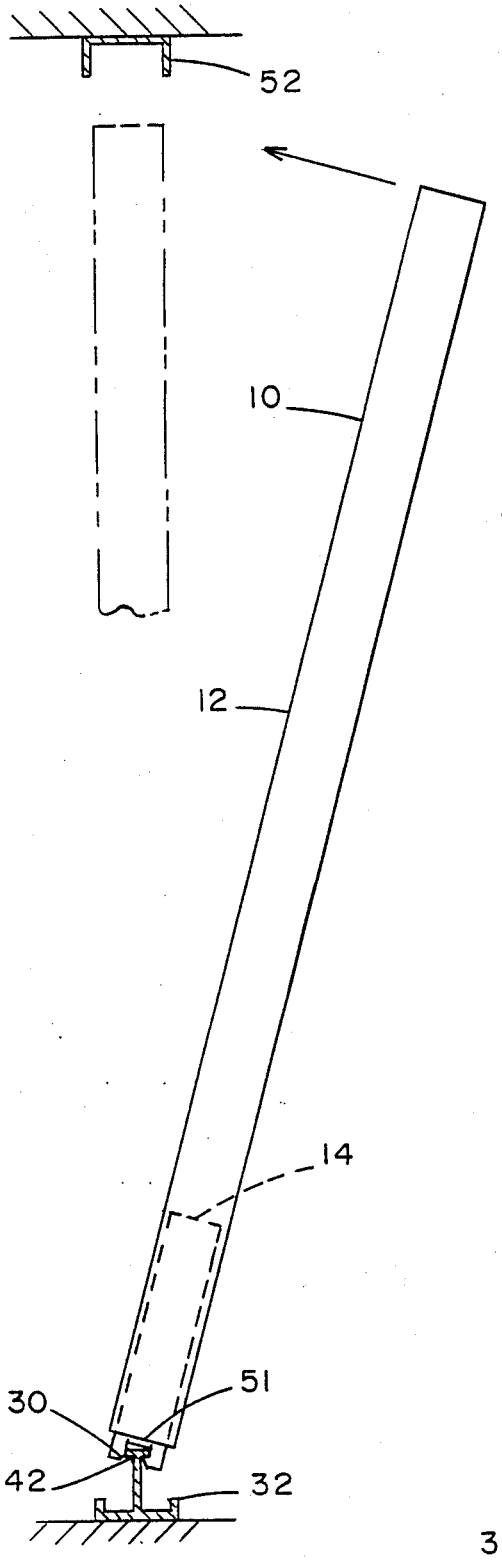
FIG. 4 is an end view of the floor track of FIGS. 2 and 3, with an extendable stud in the condition of being initially engaged onto the top flange of the floor track, with the stud also shown in broken lines in the vertical position, under a ceiling track, to which the stud is moved, to complete the interlock of the stud extender and the floor track.
Figure 5:
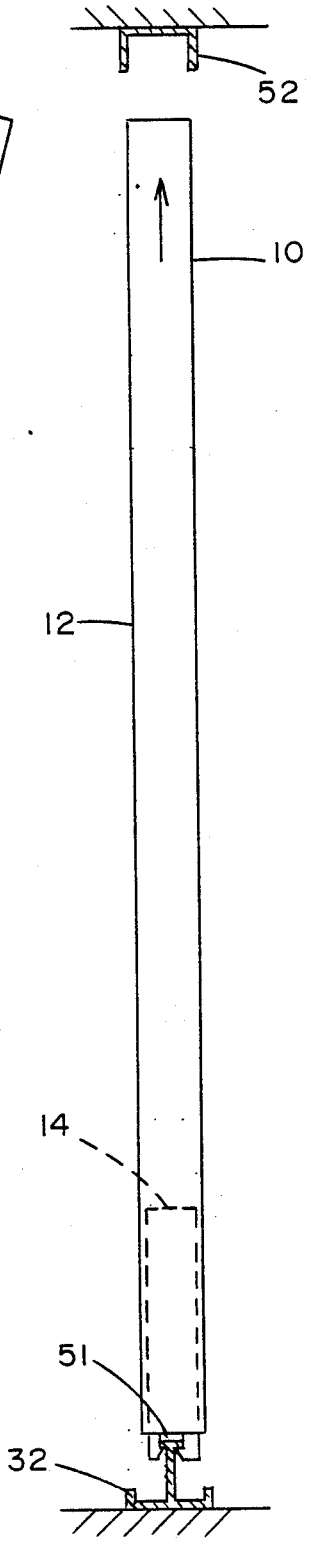
FIG. 5 is an end view of the stud and floor and ceiling tracks of FIG. 4, with the stud body about to be moved upward toward the ceiling track.
Figure 6:
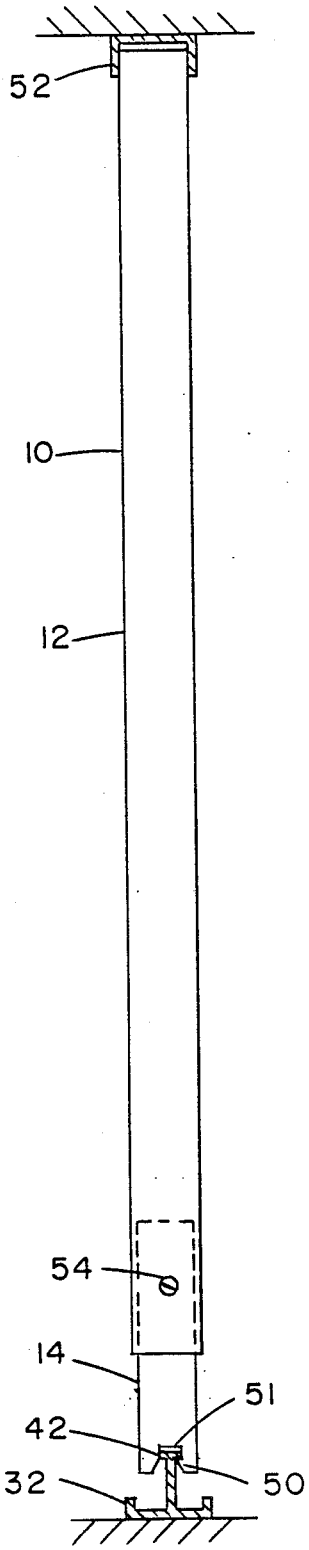
FIG. 6 is an end view of the stud and floor and ceiling tracks of FIG. 5, with the stud body extending into the ceiling track and the stud extender screw attached to the stud body.

FIGS. 4, 5 and 6 each show the stud 10, floor track 32 and a downwardly opening ceiling track 52, in progressive steps as (1) the stud extender slot 30 is placed on floor track head 42 and the stud is moved to the vertical, (2) the stud body 12 of stud 10 is moved upwardly as the stud extender 14 is held down by the engagement of the slot 30 on the floor track head 42, and (3) with the stud body 12 fully raised into the ceiling track 52, the stud body 12 and the stud extender 14 are mechanically affixed together, by a self-drilling, self-tapping screw 54 extending through overlapping portions of the stud body 12 and the stud extender 14.

Also shown in FIG. 2 is a sheet of gypsum wallboard 56 disposed with a bottom edge 58 located within the channel 34 of floor track 32, and with an inner or back face 60 disposed against the solid faces 16 and 22 of stud body 12 and stud extender 14, respectively. The wallboard normally forming the opposite side of hollow partition wall 62 is not shown. Also shown is an electrical cable 64 extending along the channel 34 and upward from channel 34 to between the back face 60 of wallboard 56 and the head 42 of floor track 32, showing how electrical cable can be disposed along a floor track and extend therefrom up into the hollow of a partition wall 62, behind the wallboard 56.

Having completed a detailed disclosure of the preferred embodiments of my invention, so that others may practice the same, I contemplate that variations may be made without departing from the essence of the invention.

I claim:

1. An extendable elongate building stud comprising an elongate sheet metal stud body and a sheet metal stud extender, said stud body and said stud extender being somewhat tightly telescopically combined, whereby said stud body and said stud extender are adjustable to provide a variable length extendable stud, said sheet metal stud body and said sheet metal stud extender each having at least one elongate web for disposition perpendicular to the general plane of a partition wall, and means on only one end of said extendable stud for longitudinally-interlockingly engaging said one end of a fixed continuous elongate track such that said extendable stud can be extended by manually moving the end of said stud not engaged with a fixed track relative to said one end which is engaged, when said one end is interlockingly engaged with said fixed track, said engaging means on said extendable stud consisting of a slot cut in at least one of said webs on one end of said extendable stud of a slot shape that includes a relatively narrow neck and a relatively wide head area above said neck, wherein said engaging means comprises a precut shape of said one end of said stud capable of engaging with a complementary shape on a fixed track and wherein said precut shape includes a precut portion which is only partially cut and which is bent out of the general plane of the stud material at said engaging means and which forms a tab which prevents said stud extender and said stud body from being retracted completely one into the other.

2. An extendable elongate building stud comprising an elongate sheet metal stud body and a sheet metal stud extender, said stud body and said stud extender being somewhat tightly telescopically combined, whereby said stud body and said stud extender are adjustable to provide a variable length extendable stud, said sheet metal stud body and said sheet metal stud extender each having at least one elongate web for disposition perpendicular to the general plane of a partition wall, and means on only one end of said extendable stud for longitudinally-interlockingly engaging said one end with a fixed continuous elongate track such that said extendable stud can be extended by manually moving the end of said stud not engaged with a fixed track relative to said one end which is engaged, when said one is interlockingly engaged with said fixed track, said engaging means on said extendable stud consisting of a slot cut in at least one of said webs on one end of said extendable stud of a slot shape that includes a relatively wide bottom opening, a relatively narrow neck and a relatively wide head area above said neck, wherein said slot is cut in the web of said stud extender.

3. An extendable stud as defined in claim 2 wherein said relatively narrow neck is formed by a locking tongue extending into the area of said slot.

4. In combination, an extendable elongate building stud comprising an elongate sheet metal stud body and a sheet metal stud extender, said stud body and said stud extender being somewhat tightly telescopically combined, whereby said stud body and said stud extender are adjustable to provide a variable length extendable stud, said sheet metal stud body and said sheet metal stud extender each having at least one elongate web for disposition perpendicular to the general plane of a partition wall, and means on only one end of said extendable stud for longitudinally-interlockingly engaging said one end with a fixed continuous elongate track such that said extendable stud can be extended by manually moving the end of said stud not engaged with a fixed track relative to said one end which is engaged, when said one end is interlockingly engaged with said fixed track, said engaging means on said extendable stud consisting of a slot cut in at least one of said webs on one end of said extendable stud of a slot shape that includes a relatively wide bottom opening, a relatively narrow neck and a relatively wide head area above said neck, said combination further comprising a fixed track, said fixed track being a fixed part of a building framework, said fixed track being an elongate element extending along the general extent of a hollow partition wall, and said fixed track having elongate means for interlockingly engaging said interlockingly engaging means of said extendable stud and wherein said fixed track is affixed to a floor along the extent of a hollow partition wall, and said extendable stud extender has said means for interlocking engagement which is interlockingly engaged with said interlocking engagement means of said fixed track, said stud extender being mechanically affixed to said stud body to prevent relative movement therebetween and said fixed track comprises an elongate bottom wall and a relatively strong upwardly extending elongate vertical wall with a relatively widened elongate head along the top of said vertical wall, and said stud extender means for interlocking engagement is a slot extending into the bottom of said stud extender in which said elongate head is interlockingly engaged.

5. The combination of claim 6 wherein said fixed track further comprises two upwardly extending sidewalls which, in combination with said bottom wall, form an upwardly opening channel, and wherein said upwardly extending vertical wall extends upwardly from the center portion of said bottom wall.

6. A partition wall comprising the combination of claim 4, and further comprising wallboards, said wallboards each having a bottom edge disposed within said upwardly opening channel and each having a back face disposed against said extendable stud, said back face being spaced apart from said fixed track elongate head, whereby utilities can be disposed within said fixed track channel and extend from said channel up into the hollow behind said wallboards above said fixed track elongate head.

7. A partition wall as defined by claim 6 wherein said stud extender further includes a tab formed from material bent out of the area of said slot, said tab forming a support element disposed on said track head whereby said tab transfers the weight of said stud to said track.

8. The method of erecting a stud during construction of a partition wall comprising the steps of interlockingly engaging an extendable stud with interlockingly engageable means on a fixed track, and subsequently extending the length of said stud to substantially the full height of said partition wall being constructed by moving said stud body relative to said stud extender until said stud is in a desired final position and desired final length, said stud comprising an elongate sheet metal stud body and a sheet metal stud extender, said stud body and said stud extender being somewhat tightly telescopically combined, and a slot with a relatively wide inwardly disposed head area extending inwardly from the end surface at one end of said extendable stud for longitudinally-interlockingly engaging said one end with a fixed continuous elongate track by a movement of the stud from a nonvertical to a vertical disposition such that said extendable stud can be extended by manually moving the end of said stud not engaged with a fixed track relative to said one end which is engaged when said one end is restrained against longitudinal movement by a locking engagement with said fixed track, wherein said extendable stud is engaged with said fixed track by joining together said interlockingly engageable means on said stud and said interlockingly engageable means on said track while holding said stud at an angle relative to vertical, and then interlocking the stud and track by moving said stud to a substantially vertical disposition and wherein said fixed track is affixed to a floor, said interlocking means on said stud is located on the bottom end of said stud extender, said stud extender is relatively shorter than said stud body, said stud is engaged with said track by manually holding said stud body while said stud extender extends a relatively short distance below a bottom end of said stud body, and while holding said stud at an angle to the vertical of about 10° to about 50°, and said engagement of said stud with said track becomes interlocking by shifting the disposition of said stud to a vertical position and wherein said stud is engaged with said track by engaging a widened head of a vertical wall of said track within a relatively wide head area of a slot in the bottom of said stud extender, said slot further including a relatively narrow neck below said relatively wide head area which is narrower than the width of said track widened head.

9. The method of erecting a stud as defined in claim 8 wherein said stud body is raised into a downwardly opening ceiling track channel while said stud extender remains engaged with said track, and wherein said stud body and said stud extender are subsequently mechanically affixed together to prevent further relative movement therebetween.

* * * * *

UNITED STATES PATENT AND TRADEMARK OFFICE

CERTIFICATE OF CORRECTION

PATENT NO. : 4,936,067

DATED : June 26, 1990

INVENTOR(S) : Robert J. Menchetti

It is certified that error appears in the above-identified patent and that said Letters Patent are hereby corrected as shown below:

On the cover page, under "FOREIGN PATENT DOCUMENTS", delete the "T" from the number "T480273".

In the Specification

At column 3, line 8, "20°" should read --10°--.

In the Claims

In claim 1, line 11 (column 3, line 68) "of" should read --with--.

In claim 2, line 15 (column 4, line 33) insert --end-- after "one" and before "is".

In claim 5, line 1 (column 5, line 17) "claim 6" should read --claim 4--.

Signed and Sealed this

Eleventh Day of June, 1991

*Attest:*

HARRY F. MANBECK, JR.

*Attesting Officer*

*Commissioner of Patents and Trademarks*